US007866536B2

(12) United States Patent
Calendrille, Jr.

(10) Patent No.: US 7,866,536 B2
(45) Date of Patent: Jan. 11, 2011

(54) PRODUCT PACKAGING END CAP

(75) Inventor: John Calendrille, Jr., Coram, NY (US)

(73) Assignee: Mattel, Inc., El Segundo, CA (US)

( * ) Notice: Subject to any disclaimer, the term of this patent is extended or adjusted under 35 U.S.C. 154(b) by 820 days.

(21) Appl. No.: 11/828,869

(22) Filed: Jul. 26, 2007

(65) Prior Publication Data

US 2008/0023360 A1 Jan. 31, 2008

Related U.S. Application Data

(60) Provisional application No. 60/834,169, filed on Jul. 31, 2006.

(51) Int. Cl.
*B65D 85/00* (2006.01)

(52) U.S. Cl. ..... 229/5.5; 206/407; 206/416

(58) Field of Classification Search ..... 229/403, 229/404, 405, 125.36, 125.17, 93; 206/407, 206/416, 410, 413, 414, 415; 220/600; 215/298, 215/363, 227

See application file for complete search history.

(56) References Cited

U.S. PATENT DOCUMENTS

| | | | | |
|---|---|---|---|---|
| 880,952 | A | 3/1908 | Yarnall | |
| 914,960 | A * | 3/1909 | Lee | 215/309 |
| 1,744,026 | A * | 1/1930 | Baltzley | 215/298 |
| 2,044,422 | A | 6/1936 | Davidson | |
| 2,056,956 | A | 10/1936 | Carpenter | |
| 2,392,959 | A | 1/1946 | Van Saun | |
| 2,711,851 | A | 6/1955 | Rabby | |
| 3,333,685 | A | 8/1967 | Pezdek | |
| 3,563,448 | A | 2/1971 | Croley | |

(Continued)

FOREIGN PATENT DOCUMENTS

| | | | |
|---|---|---|---|
| GB | 1076362 | A | 7/1967 |

*Primary Examiner*—Nathan J Newhouse
*Assistant Examiner*—Christopher Demeree
(74) *Attorney, Agent, or Firm*—Edell, Shapiro & Finnan, LLC

(57) ABSTRACT

The present invention relates to a packaging concept includes a tubular wall member and end caps. The packaging is constructed from a sheet of flexible material wrapped into a continuous wall and fastened at the ends of the sheet material leaving open tube ends. The open ends of the tube are then closed by an end cap. The end caps are each formed from a continuous blank of sheet material. The blank includes at least three aligned cap layers. The first and second cap layers are adjacent to each other and connected by a tab connector. Each of the first and second cap layers also includes a plurality of bendable support tabs and each of the first and second cap layers includes a plurality of spaces between adjacent respective bendable support tabs. The first cap layer is folded relative to the second cap layer such that the support tabs of the first cap layer enter the spaces of the second cap layer and the support tabs of the second cap layer enter the spaces of the first cap layer. The first and second cap layers are smaller than the open tube ends and the third and fourth cap layers are larger than the open tube ends. Therefore, the first and second cap layers enter the open tube ends and the third and fourth cap layers abut the open tube ends to provide cap that can be secured to the tubular wall member by an adhesive product.

18 Claims, 19 Drawing Sheets

U.S. PATENT DOCUMENTS 3,929,271 A 12/1975 Meyers
4,008,804 A 2/1977 Poggiali
4,179,030 A 12/1979 Hayes et al.
4,251,021 A 2/1981 Swan
4,291,803 A 9/1981 Perales
4,504,009 A * 3/1985 Boik et al. ..... 229/5.5
5,337,895 A 8/1994 Mitelman et al.
6,170,740 B1 1/2001 Clark

* cited by examiner

PRODUCT PACKAGING END CAP

CROSS REFERENCE TO RELATED APPLICATION

This application claims the benefit of U.S. Provisional Application No. 60/834,169, entitled "Product Packaging End Cap" and filed on Jul. 31, 2006, the disclosure of which is hereby incorporated by reference in its entirety.

BACKGROUND OF THE INVENTION

The present invention relates to packaging including a sidewall or sidewalls constructed of flexible sheet(s) of material enclosed by end caps assembled from a foldable sheet material. More particularly, the end caps of the present invention are easily and quickly manufactured and assembled from inexpensive sheet material (e.g., paper, plastic, E-flute (cardboard) etc.).

One way of packaging an item for sale is to provide packaging that includes at least one wall member with a transparent window portion. A shopper can view the product being sold through the transparent window portion of the wall of the packaging. The wall can be constructed from multiple materials. For example, the wall of the packaging can be made from cardboard while the transparent window portion can be made from a transparent plastic.

A simple efficient product packaging structure can include a wall made entirely of the same material. Because at least a portion of the wall must be transparent, the wall could be made entirely from a transparent material or could be made from a transparent material that is partially colored leaving a transparent window. If an entire wall is formed from the transparent material, the material would generally need to have structural properties to adequately maintain the structural integrity of the packaging at least under normally anticipated modes of use of the packaging.

From a cost perspective, generally, the thinner the packaging is, the more cost effectively the packaging may be manufactured. However, generally, the thinness of a wall material is inversely proportional to the structural integrity it provides. Therefore a balance must be achieved that provides a minimal desired structural performance while minimizing material and manufacturing costs.

A cylindrical tube with no end caps (e.g., made from a thin flexible sheet of acetate) has different strengths in different modes of use. Generally, the tube is relatively weak when compressed inwardly in the radial direction and in the middle of its length. The tube is even weaker when compressed inwardly in the radial direction at the end of a tube with no end caps. In contrast the tube is relatively strong when loaded evenly in the longitudinal axial direction (the same compressive mode as loading a column in a building).

When end caps are added to a cylindrical tube, the wall's performance improves. The tube wall becomes stronger when compressed inwardly in the radial direction and in the middle of the tube's length. The tube also becomes even stronger when compressed inwardly in the radial direction and at the end of the tube near the end cap. Therefore, simply adding end caps to a cylindrical wall made of thin sheet material can dramatically increase the structural integrity of a product package in significant modes of use.

Creating a wall from a thin flexible transparent material can accomplished cheaply and simply. Therefore, what remains is to create a simple structurally and functionally sound end cap that can be easily and cheaply manufactured. Other end caps for flexible transparent containers have been made from a variety of materials of varying costs. However, there is a long felt need to develop an end cap having a structure permitting easy and cost effective manufacture and assembly.

SUMMARY OF THE INVENTION

Generally, the device of the present invention includes an end cap for a packaging container. More specifically, the device of the present invention includes an end cap for a cylindrical/tubular packaging container. A packaging container in accordance with the present invention may include a tubular side wall and at least one end cap. In addition, the end cap may have a desirable multilayered structure that easily fits in and is secured to the end of the tubular wall member to complete the package's cylindrical shape. An end cap in accordance with the present invention can be made from inexpensive materials (e.g., paper, plastic etc.) and can be configured to be easily and cost-effectively assembled.

In the illustrated embodiment of the present invention, the end caps are circular. However, any packaging or end cap shape can be used (e.g., circular, oval, rectangular, star-shaped etc.) without departing from the scope of the present invention. Assembly of an end cap according to the present invention can be accomplished in a short time by folding the sheet material from a single flat continuous blank into a multilayered end cap structure. Specifically, the blank may include at least three linearly connected cap layers. In the illustrated embodiment, the flat blank includes four adjacent cap layers connected by three tab connectors. The radii of the first and second cap layers are smaller that the radii of the third and fourth cap layers. However, an end cap according to the present invention can be assembled and can function without the fourth cap layer. The first and second cap layers may each include a plurality of support tabs extending radially from their perimeters. The support tabs form spaces between them for receiving the support tabs of the other cap layer during assembly of the end cap. The support tabs each include a separation portion and a contact portion. In addition, between each cap layer and each tab member is a first tab bend (a fold line) and between each separation portion and each contact portion is a second tab bend (a fold line).

To form the finally assembled end cap according to the present invention, the support tabs of the adjacent first and second circular cap layers, are folded into an L-shaped configuration. The first and second cap layers are then folded toward each other such that the support tabs (now folded into an L-shape) of the first cap layer enter the spaces formed between the support tabs (now folded into an L-shape) of the second cap layer. Furthermore, the support tabs of the second cap layer enter the spaces formed between the support tabs of the first cap layer.

The assembly of the combined first and second cap layers is then folded relative to the third cap layer and the third cap layer is folded relative to the fourth cap layer. Adhesive can be placed on surface portions of the cap layers where the surface portions will come in contact with another part of the blank to hold the assembly in position.

The radii of the first and second cap layers are smaller than the terminal end opening in the terminal end of the packaging wall and the first and second cap layers are smaller than the radii of the third and fourth cap layers. In contrast, the radii of the third and fourth cap layers are larger than the terminal end opening in the terminal end of the packaging wall. As a result, after assembly, each end cap includes a rim surface formed by the larger third and fourth cap layers that extend radially past the first and second cap layers. In addition, when the end caps are placed on the terminal ends of the packaging wall(s) the smaller first and second cap layers pass into the terminal end opening at the terminal end of the packaging wall(s) while the larger third and fourth cap layers abut the opening of the packaging wall(s) at the rim surface. The assembled packaging wall(s) and the end caps define a volume within which a product for sale can be packaged and displayed.

BRIEF DESCRIPTION OF THE DRAWINGS

Like reference numerals have been used to identify like elements throughout this disclosure.

DETAILED DESCRIPTION OF THE INVENTION

Figure 1:
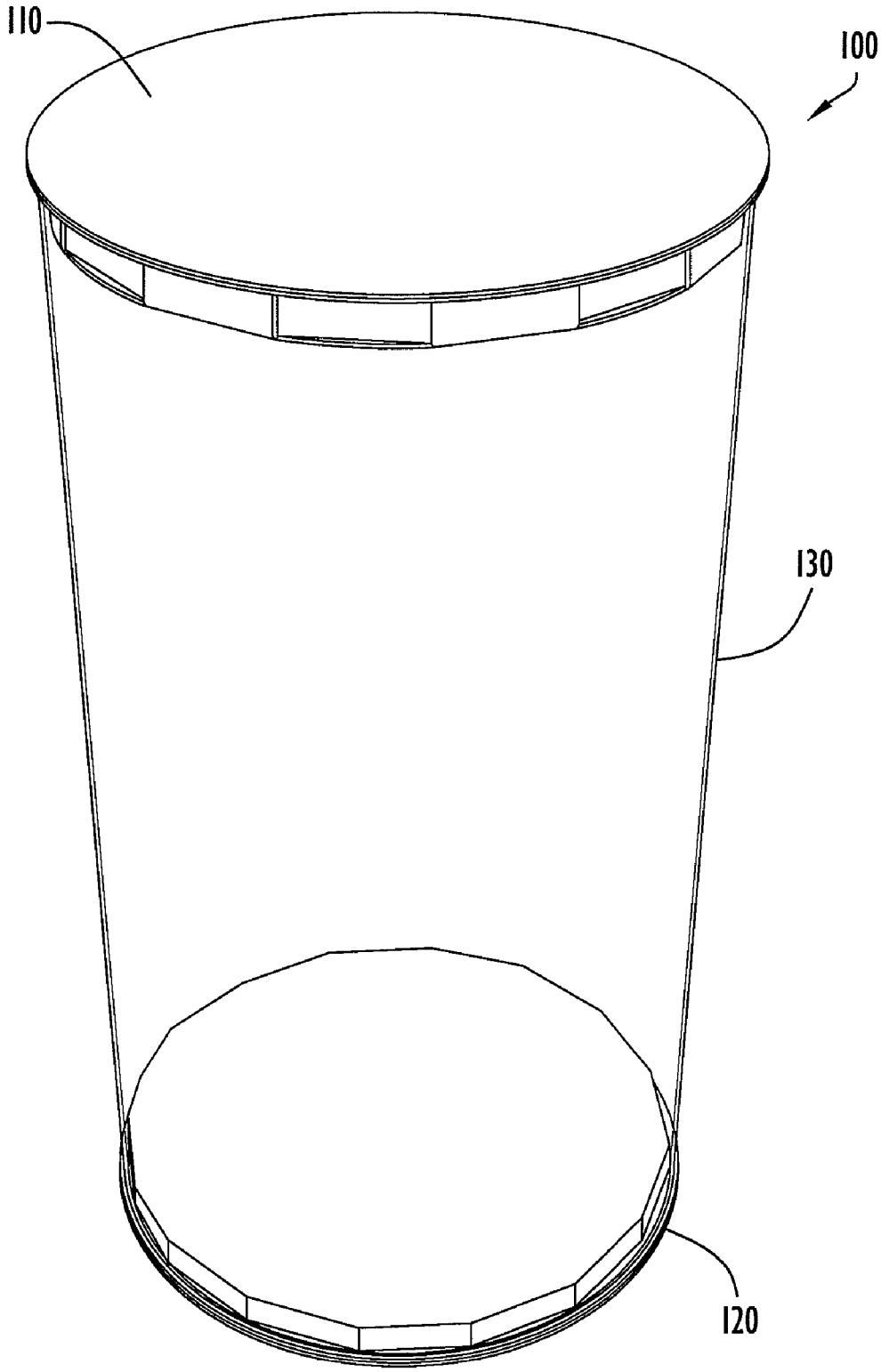
FIG. 1 illustrates a perspective view of an embodiment of the packaging end cap in accordance with the present invention including a transparent wall member (shown with two end caps).

In accordance with the present invention, a packaging end cap is disclosed. FIG. 1 illustrates a perspective view of an embodiment of the packaging end cap 100 in accordance with the present invention including two end caps 110, 120 and a tubular wall member 130. As referenced above, although in the illustrated embodiment of the present invention, the end caps are circular, any packaging or end cap shape can be used (e.g., circular, oval, rectangular, star-shaped etc.) without departing from the scope of the present invention. The two end caps 110, 120 are identical in structure and, therefore, may be described hereinafter as a single end cap. The tubular wall member 130 may be formed from a thin sheet of material bent into a tube shape and connected at edges of the sheet. Product packaging may typically include a transparent window through which the product inside can be viewed. As shown in the illustration of FIG. 1, the entire wall of the package may be formed from a transparent material. Alternatively, the tubular wall of the package can be constructed entirely of transparent material and the portions of the wall, not intended to be transparent, can be colored or covered before or after assembly.

Figure 2:
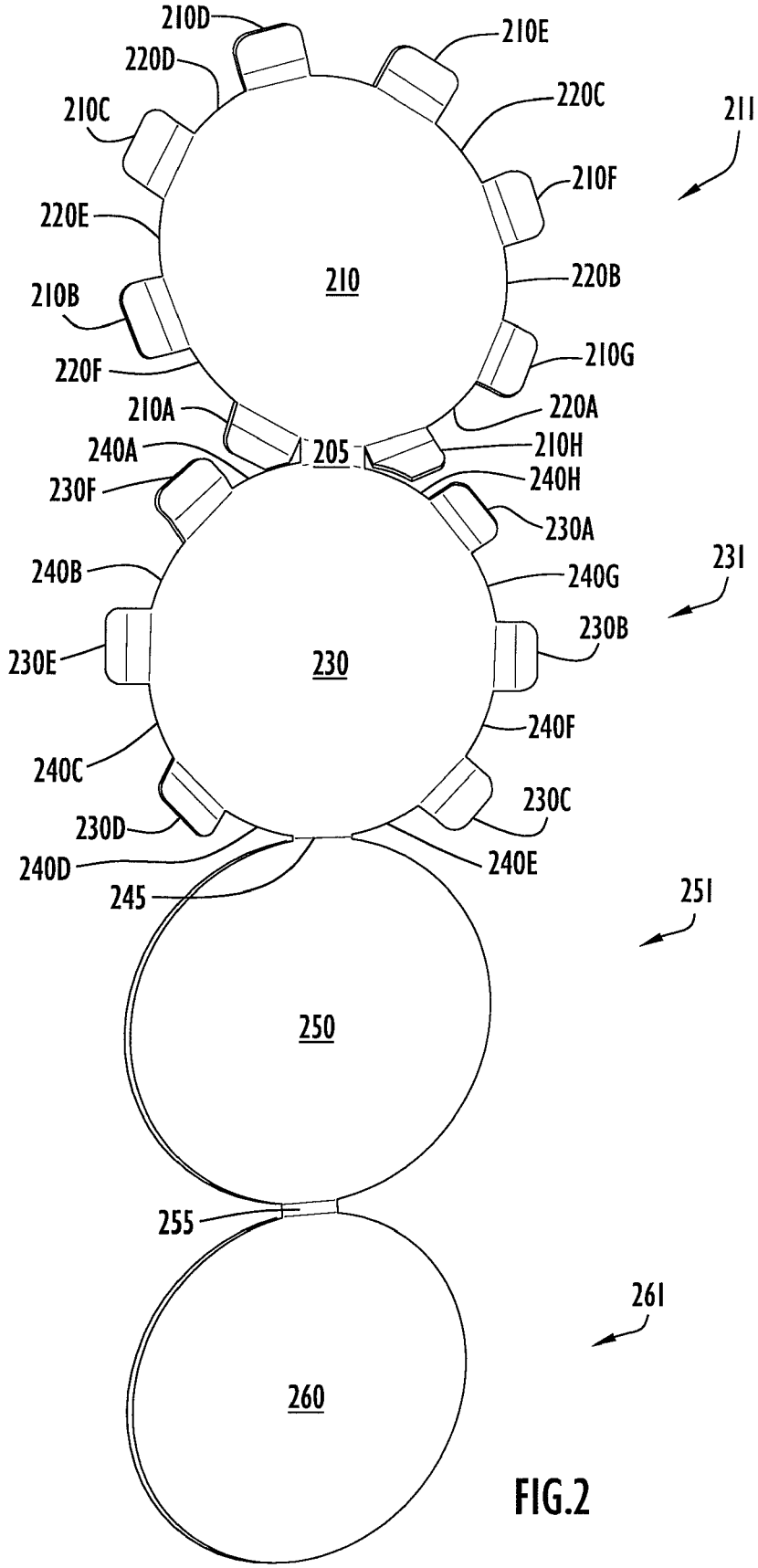
FIG. 2 illustrates a top view of an outer side of an end cap in accordance with the present invention unfolded to reveal the continuous blank from which the end cap may be formed.

FIG. 2 illustrates a top view of an outer side 210, 230, 250, and 260 of an end cap 110, 120 in accordance with the present invention unfolded to reveal the continuous blank from which the end cap 110, 120 may be formed. The end cap 110, 120 is formed from a continuous blank 200 from which the end cap 110, 120 is formed. The blank 200 includes first cap layer 211, second cap layer 231, third cap layer 251 and fourth cap layer 261. The first cap layer 211 and second cap layer 231 include a plurality of support tabs 210A-H, 230A-F. As shown, in FIG. 2, support tabs 210A-H project from the first cap layer 211 and support tabs 230A-F project from the second cap layer 231. First cap layer 211 and second cap layer 231 also include a plurality of spaces 220A-F, 240A-H formed between support tabs 210A-H, 230A-F. The spaces 220A-F are formed on first cap layer 211 while spaces 240A-H are formed on second cap layer 231. Furthermore, first cap layer 211 is connected to second cap layer 231 by tab connector 205 and second cap layer 231 is connected to third cap layer 251 by tab connector 245. Finally, third cap layer 251 is connected to fourth cap layer 261 by tab connector 255.

Figure 3:
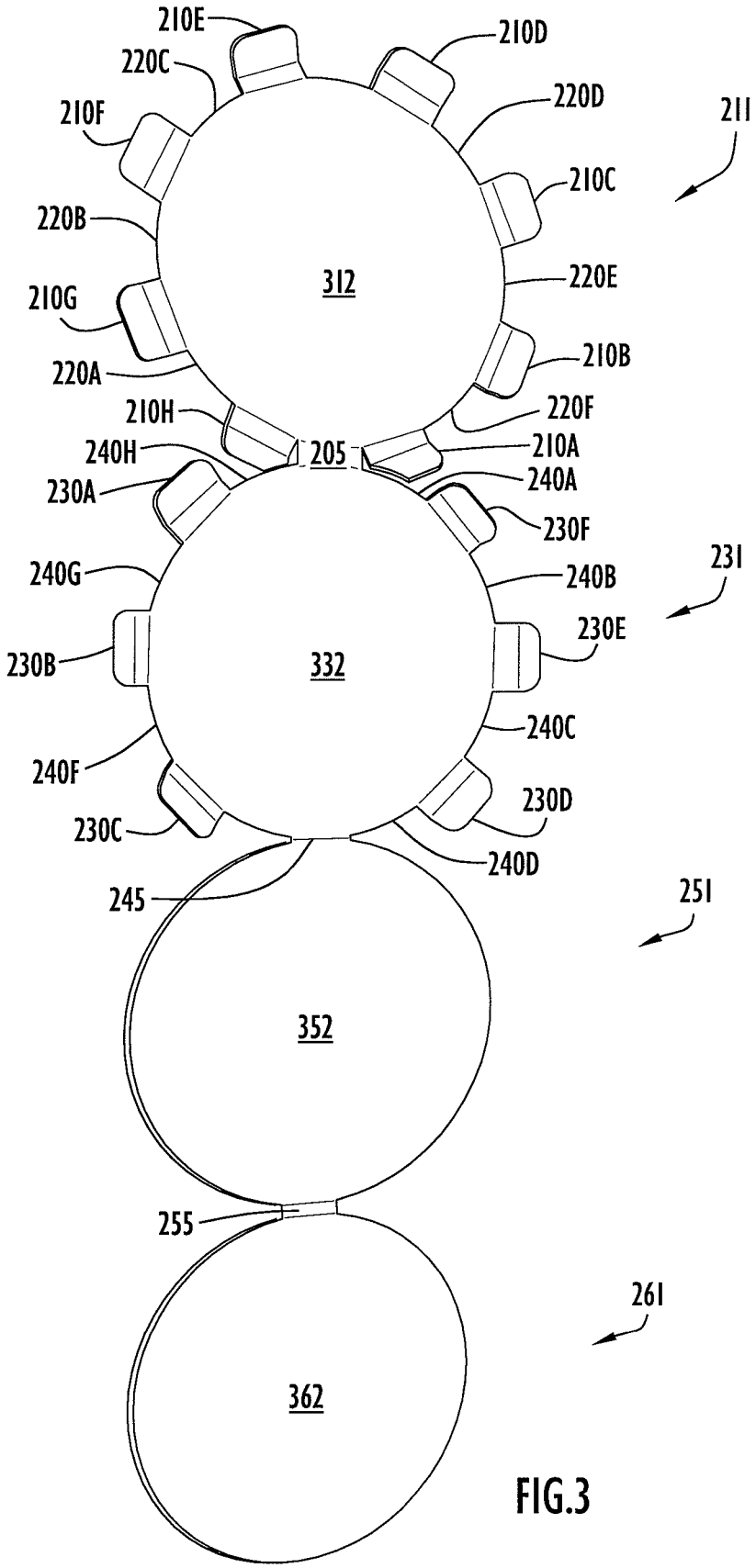
FIG. 3 illustrates a top view of an opposite side (with respect to FIG. 2) of an end cap in accordance with the present invention unfolded to reveal the continuous blank from which the end cap may be formed.

FIG. 3 illustrates a top view of the blank of FIG. 2 showing an opposite side 312, 332, 352, and 362 to each of the outer sides 210, 230, 250, and 260 of the blank 200 in accordance with the present invention. FIG. 3 shows the opposite side 312, 332, 352, and 362 of the continuous blank 200 and shows the plurality of radial support tabs 210A-H, 230A-F. Similar to FIG. 2, FIG. 3 also shows blank 200 including the first cap layer 211, second cap layer 231, third cap layer 251, and fourth cap layer 261. FIG. 3 shows support tabs 210A-H projecting from the first cap layer 211 and support tabs 230A-F projecting from the second cap layer 231. First cap layer 211 and second cap layer 231 also include the plurality of spaces 220A-F, 240A-H formed between support tabs 210A-H, 230A-F respectively. Again, the spaces 220A-F are formed on first cap layer 211 while spaces 240A-H are formed on second cap layer 231.

Figure 4:
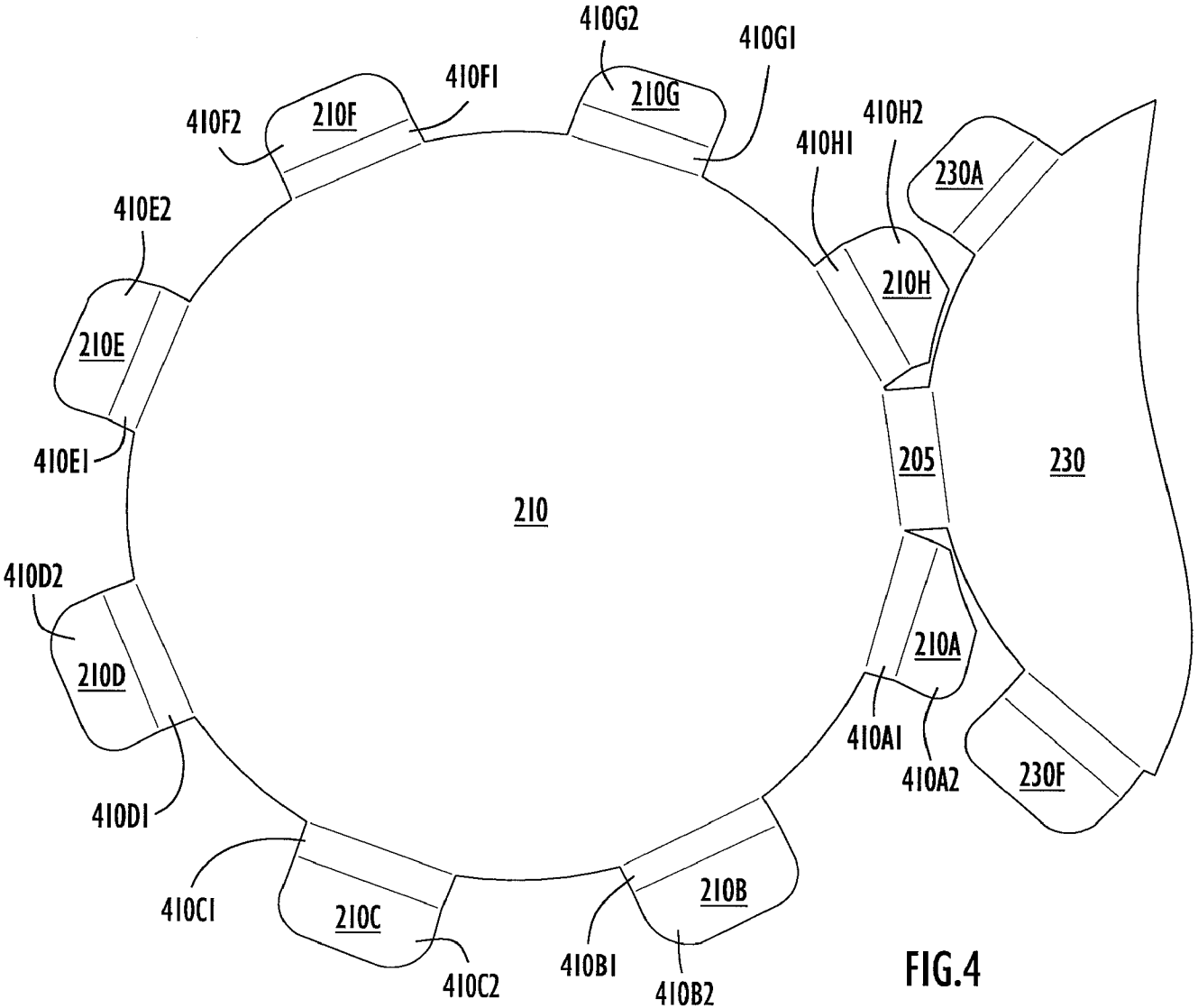
FIG. 4 illustrates an enlarged view of a first cap layer of the end cap of FIG. 2 and its attachment by a first connection tab to a second cap layer.

FIG. 4 illustrates an enlarged (210, 230, 250, 260) view of the first cap layer 211 of the end cap 110, 120 of FIG. 2 and its attachment by a first connection tab 205 to the second cap layer 231. FIG. 4 also shows that each support tab 210A-H, of the first cap layer 211 includes two distinct portions, separation portions 410A1-H1 and contact portions 410A2-H2. The precise function of the separation portions 410A1-H1 and contact portions 410A2-H2 of cap layer 211 will be discussed in greater detail below. Each support tab 210A-H also includes a base bend line (or fold line) 410BB between the cap layer 211 and each support tab 210A-H. In addition, each support tab 210A-H includes a tab bend line (or fold line) 410BT between each separation portion 410A1-H1 and each contact portion 410A2-H2.

Figure 5:
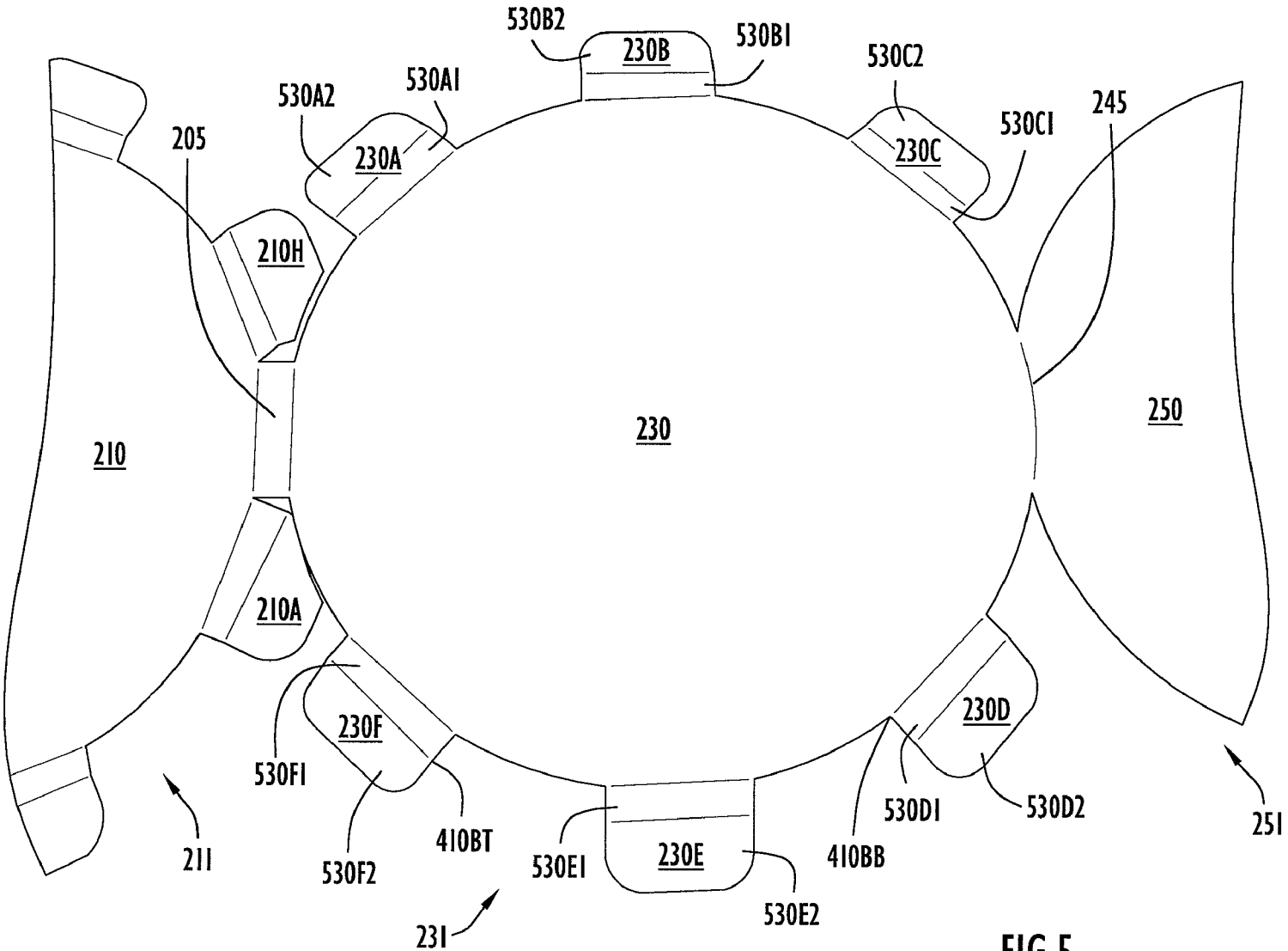
FIG. 5 illustrates an enlarged view of the second cap layer of the end cap of FIG. 2 and its attachment to the first cap layer by the first connection tab and its attachment to a third cap layer by a second connection tab.

FIG. 5 illustrates an enlarged 210, 230, 250, and 260 view of the second cap layer 231 of FIG. 2 and its attachment to the first cap layer 211 by the first connection tab 205 and its attachment to a third cap layer 251 by the second connection tab 245. More specifically, similar to the illustration of FIG. 4, FIG. 5 shows that each support tab 230A-F, of cap layer 231 includes two distinct portions, a separation portion 530A1-F1 and a contact portion 530A2-F2. Again, the precise function of the separation 530A1-F1 and contact 530A2-F2 portions of cap layer 231 will be discussed in greater detail below. Each support tab 230A-F also includes a base bend 410BB between the cap layer 231 and each support tab 230A-F. In addition, each support tab 230A-F includes a tab bend 410BT between each separation portion 530A1-F1 and each contact portion 530A2-F2.

Figure 6:
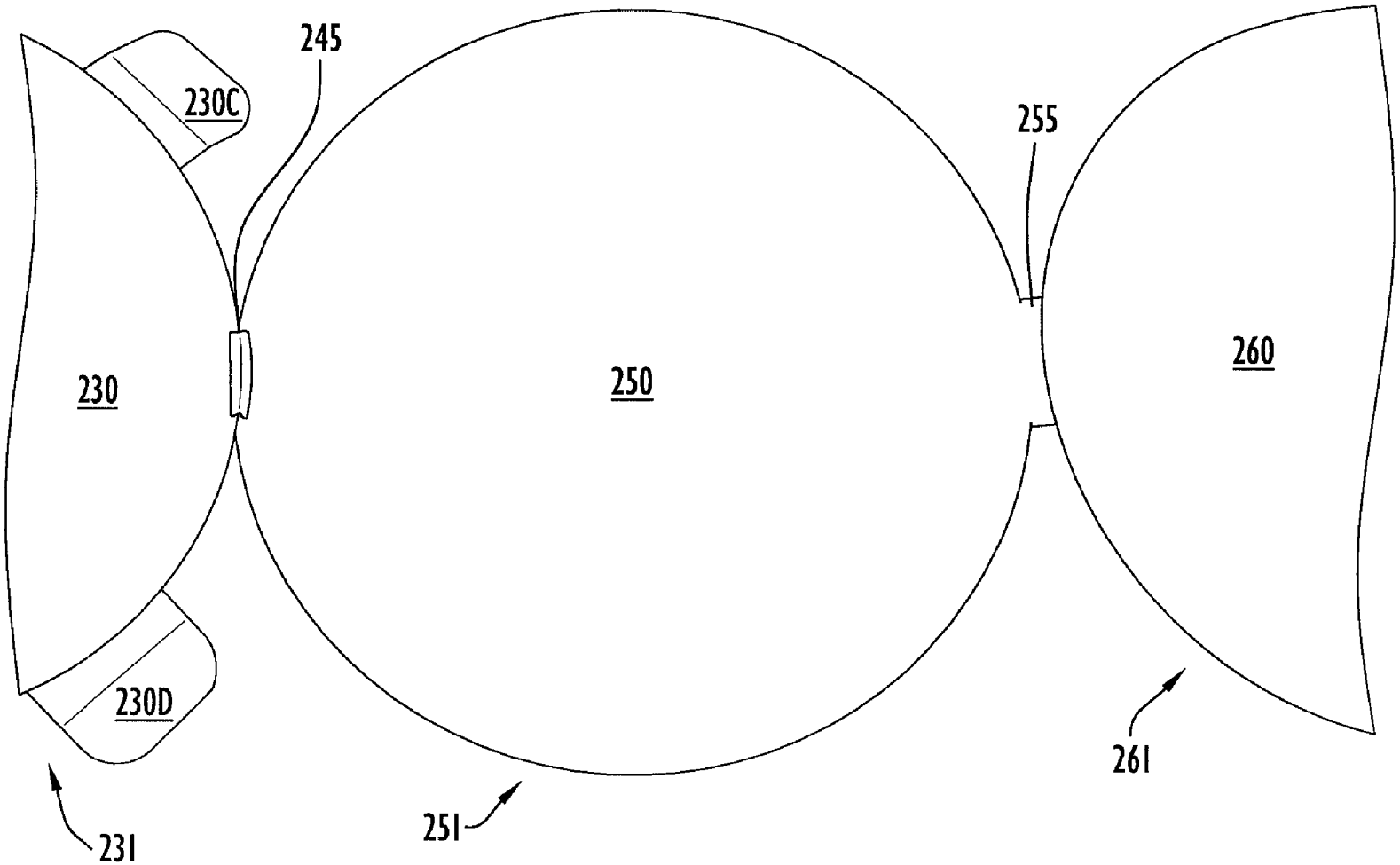
FIG. 6 illustrates an enlarged view of the third cap layer of the end cap of FIG. 2 and its attachment to the second cap layer by the second connection tab and its attachment by a third connection tab to a fourth cap layer.
Figure 7:
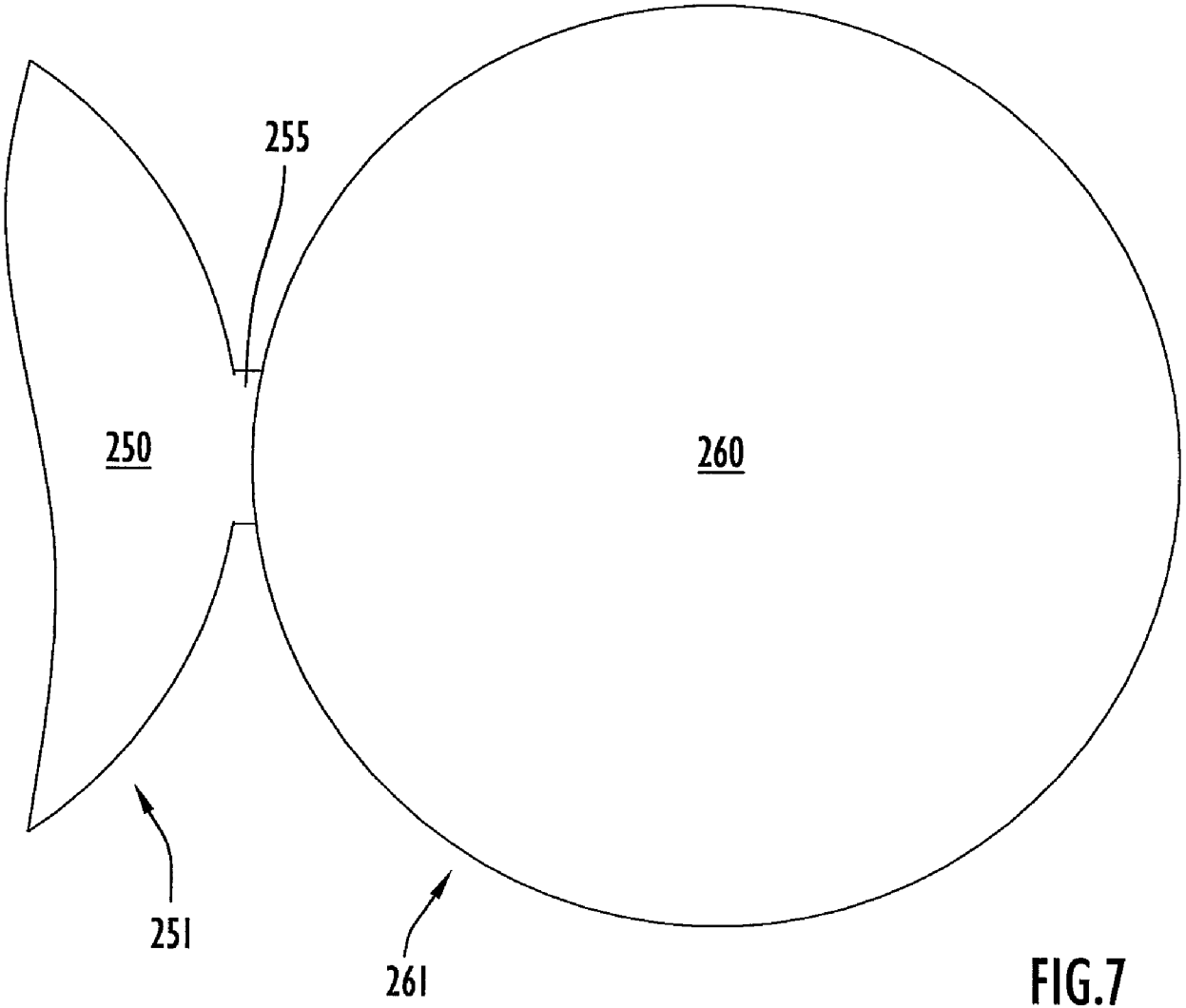
FIG. 7 illustrates an enlarged view of the fourth cap layer of the end cap of FIG. 2 and its attachment to the third cap layer by the third connection tab.

FIG. 6 illustrates an enlarged 210, 230, 250, 260 view of the third cap layer 251 of FIG. 2 and its attachment to the second cap layer 231 by the second connection tab 245 and the third cap layer 251 connection with the fourth cap layer 261 by a third connection tab 255. Furthermore, FIG. 7 illustrates an enlarged outer side (210, 230, 250, and 260) view of the fourth cap layer 261 of FIG. 2 and its attachment to the third cap layer 251 by the third connection tab 255.

Figure 8:
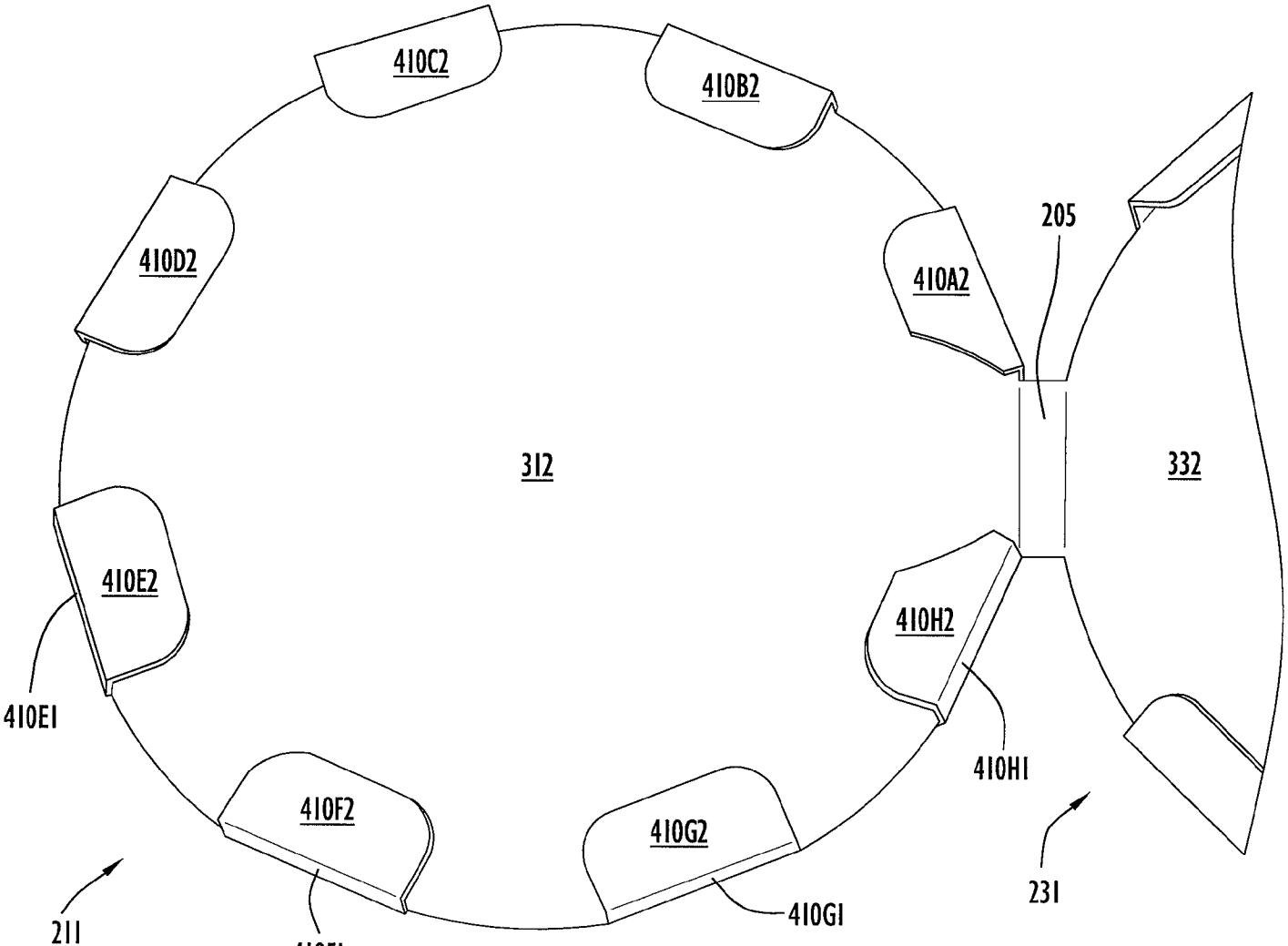
FIG. 8 illustrates an enlarged view of the first cap layer of the end cap of FIG. 3 showing its plurality of support tabs in their folded position.

FIG. 8 illustrates an enlarged side (312, 332, 352, and 362) view of the first cap layer 211 of FIG. 2 showing its plurality of support tabs 210A-H in their folded position. FIG. 8 shows each support tab 210A-H in a folded along its base bend 410BB at a 90 degree angle and along its tab bend 410BT at a 90 degree angle. In other words, each tab 210A-H is folded into an L-shaped configuration such that its separation portion 410A1-H1 is perpendicular to the first cap layer 211 and its contact portion 410A2-H2 is parallel with the first cap layer 211. Finally, FIG. 8 shows connection tab 205 which has a width approximately the same as each separation portion 410A1-H1.

Figure 9:
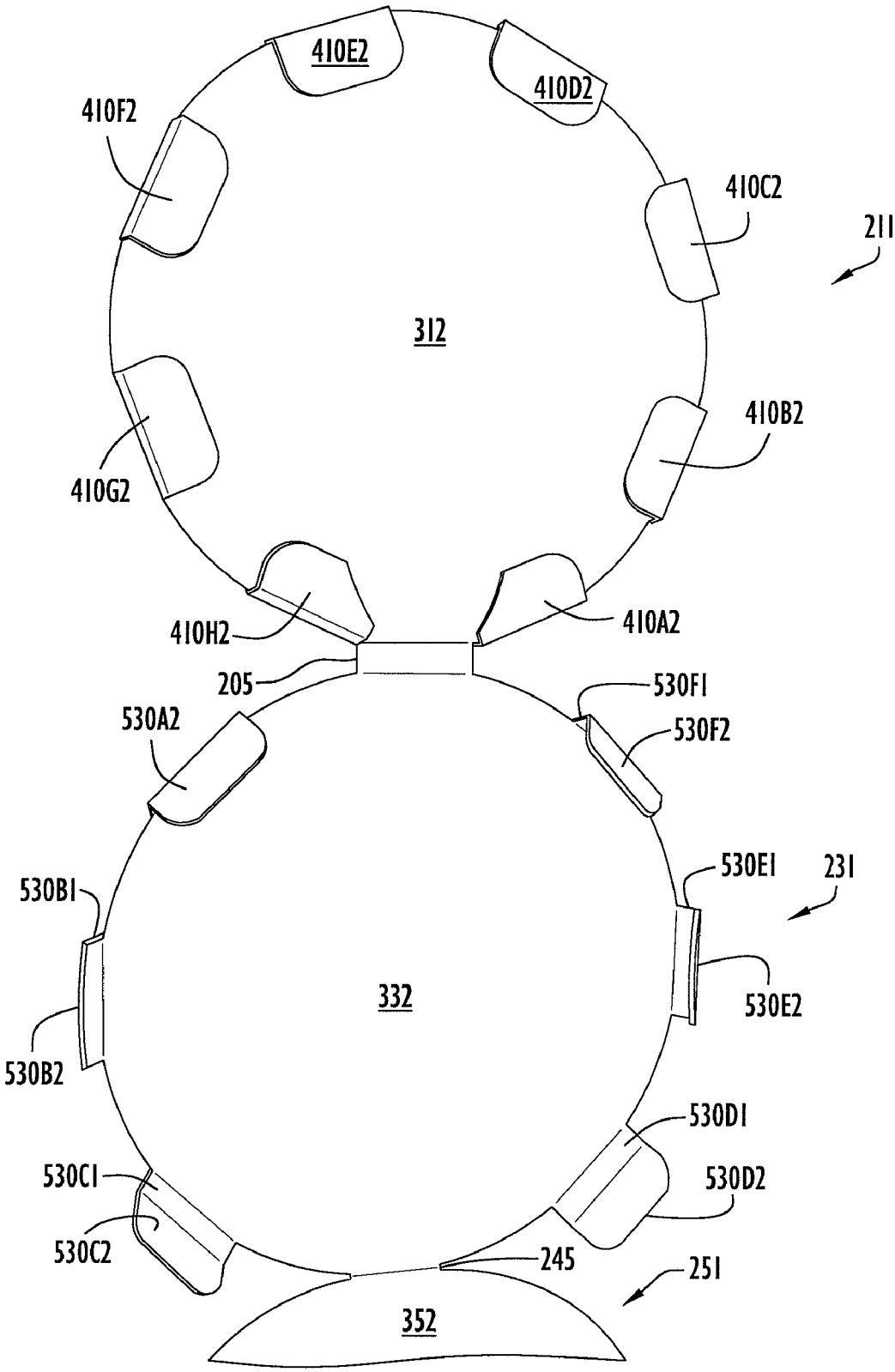
FIG. 9 illustrates an enlarged view of the first cap layer of the end cap of FIG. 3 showing its plurality of support tabs in their fully folded position and the second cap layer showing its plurality of support tabs in pre-fold positions.

FIG. 9 illustrates an enlarged side view of the first cap layer 211 of FIG. 3 showing its plurality of support tabs 210A-H into their folded L-shaped configuration and also showing the second cap layer 231 with its plurality of support tabs 230A-F in pre-fold positions before they are bent into their L-shaped configuration. Like the support tabs 210A-H on cap layer 211, the support tabs 230A-F on the cap layer 231 must also be folded from the pre-folded positions into the L-shaped configuration described above (such that each tab's separation portion 530A1-F1 is perpendicular to the second cap layer 231 and its contact portion 530A2-F2 is parallel with the second cap layer 231).

After folding support tabs 210A-H, 230A-F into their L-shaped configuration, first cap layer 211 is folded onto cap layer 231 such that side 312 of first cap layer 211 and side 332 of second cap layer 231 face each other. After folding, first cap layer 211 and second cap layer 231 are positioned parallel to each other separated by a distance approximately equal to the length of the separation portions of the support tabs 210A-H, 230A-F as well as the length of the tab connector 205. Finally, after folding of cap layers 211 and 231 via tab connector 205, support tabs 210A-H of first cap layer 211 and support tabs 230A-F of second cap layer 231 become interspersed between each other. Specifically, after folding first cap layer 211 onto second cap layer 231, support tabs 210A-H of first cap layer 211 are disposed in spaces 240A-H of second cap layer 231 respectively. Similarly, after folding, support tabs 230A-F of second cap layer 231 are disposed in spaces 220A-F of first cap layer 211 respectively.

Figure 10:
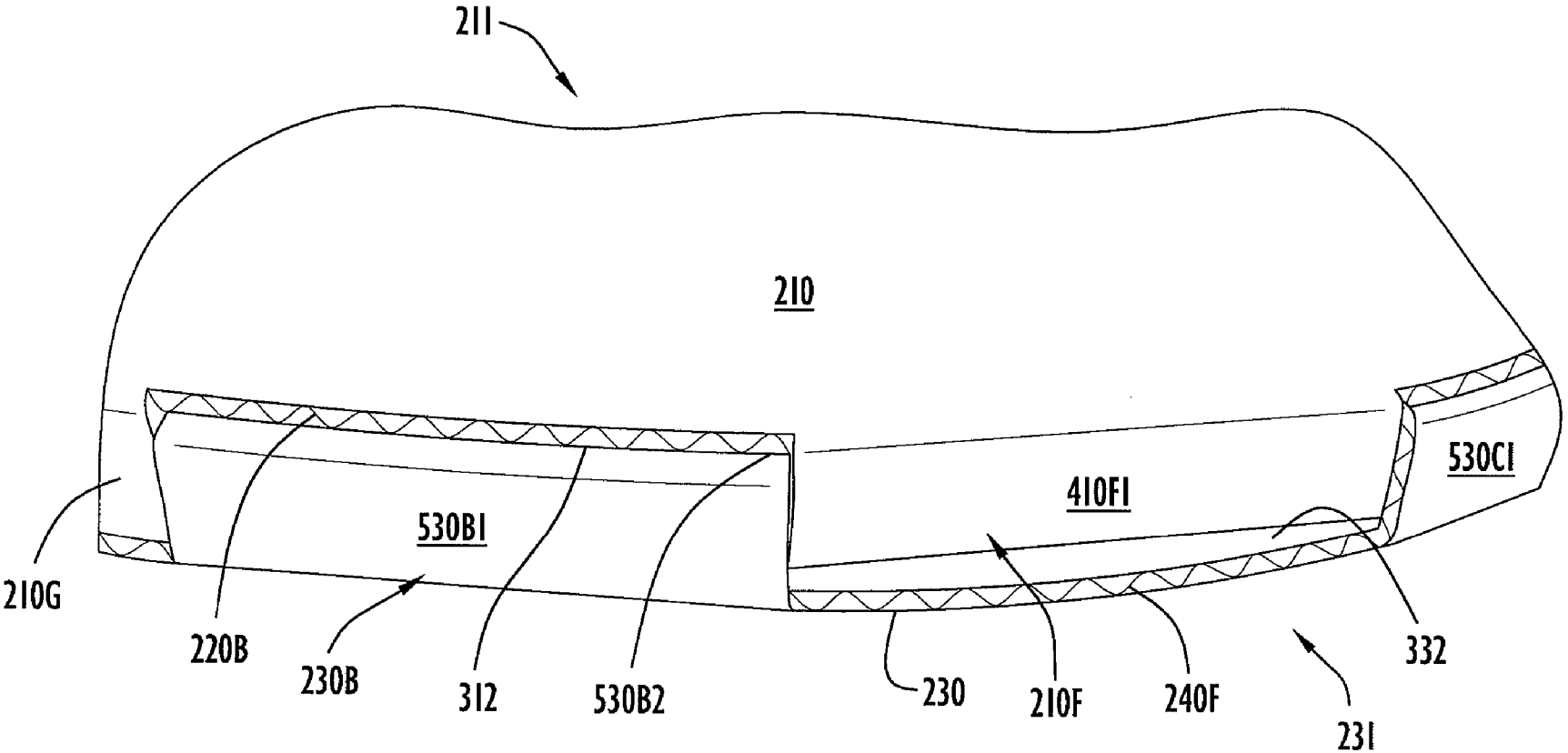
FIG. 10 illustrates an enlarged perspective view of the first and second cap layers and support tabs of the end cap of the present invention in their completely folded and interlocking positions.

FIG. 10 illustrates an enlarged perspective view of the first cap layer 211, the second cap layer 231 and some of support tabs 210A-H and 230A-F in their completely folded and interlocking positions. For example, FIG. 10 shows separation portion 530B1 bent upward relative to cap layer 231 at a right angle to finally rest perpendicular to cap layer 231. Space 220B is formed between support tab 210F and support tab 210G and space 240F is formed between support tab 230B and support tab 230C. FIG. 10 also shows a small amount of contact portion 530B2 extending from separation portion 530B1 and extending parallel to and toward the center of cap layer 211. The outer side of contact portion 530B2 (partially shown in FIG. 10) contacts the opposite side 312 of first cap portion 211. Similarly, the outer side of each contact portion 410A2-H2 contacts the opposite side 332 of second cap layer 231. In addition, the outer side of each contact portion 530A2-F2 contacts the opposite side 312 of first cap layer 211.

FIG. 10 shows separation portion 410F1 bent downward relative to first cap layer 211 at a right angle to finally rest perpendicular to first cap layer 211. The outer side of contact portion 410F2 (not clearly shown, but attached to separation portion 410F1) contacts the opposite side 232 of second cap portion 231. Adhesive may be applied to the outer side of any of the contact portions 410A2-H2, 530A2-F2 to secure the contact portions 410A2-H2, 530A2-F2 to their respective opposite sides 312 and 332. Such adhesive placement would, in turn, secure first cap layer 211 to second cap layer 231. In any case, the first cap layer 211 and the second cap layer 231 can be secured together by a friction interlock between the support tabs 210A-H, 230A-F when no adhesive is used. Furthermore, other types of additional locking tabs may be employed to hold the various parts of the end cap together with or without the use of an adhesive.

Figure 11:
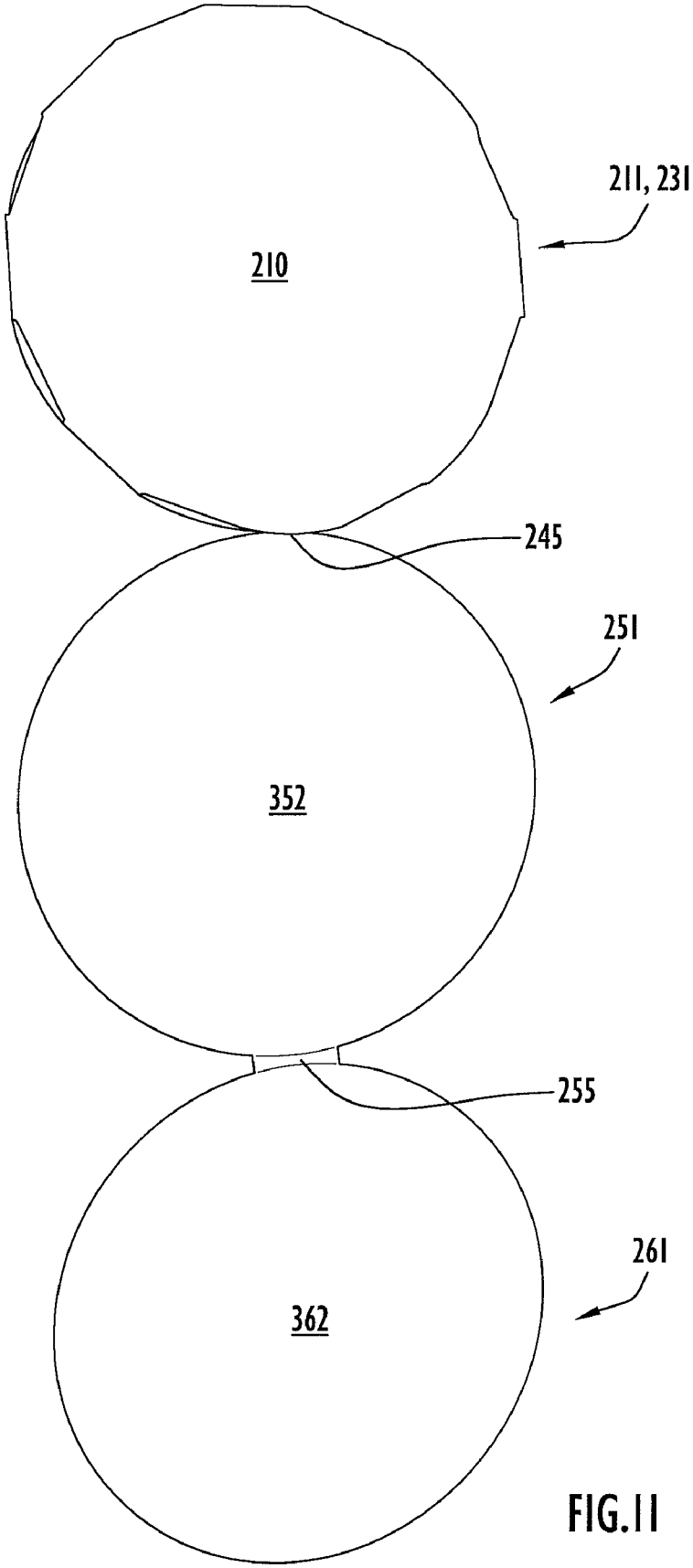
FIG. 11 illustrates a top view of the completely folded first and second cap layers of FIG. 10 and also showing the third and fourth cap layers connected thereto by the second and third connection tabs.
Figure 12:
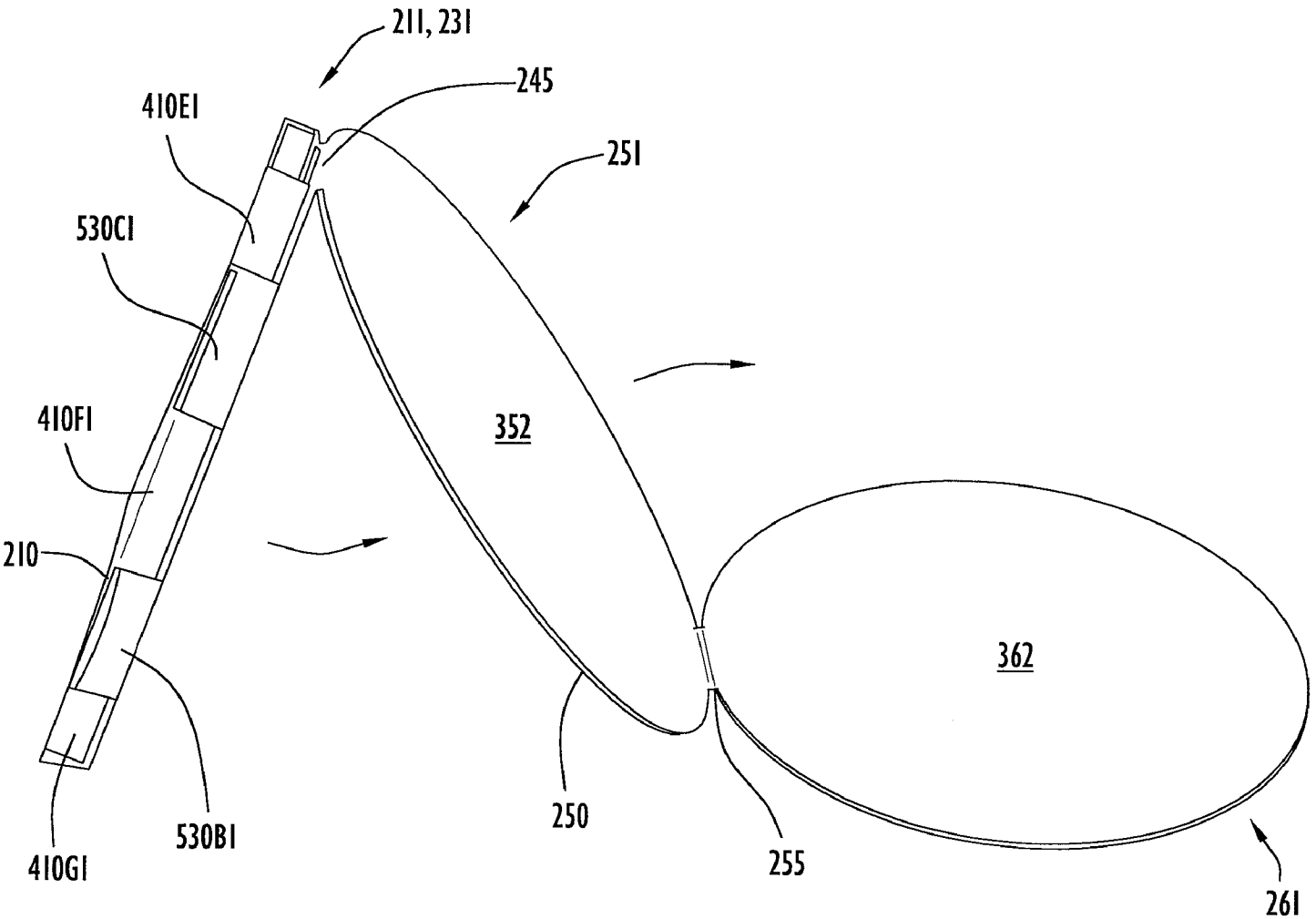
FIG. 12 illustrates a side perspective view of the assembled first and second cap layers, with the third cap layer and the fourth cap layer being folded into a completely assembled end cap in accordance with the present invention.

FIG. 11 illustrates a top view of the first cap layer 211 foldably secured to the second cap layer 231 and also shows the third cap layer 251 connected to the second cap layer 231 by the second tab connecter 245. Also, the fourth cap layer 261 is connected to the third cap layer 251 by tab connector 255. FIG. 12 illustrates a side perspective view of the assembled first cap layer 211 and second cap layer 231, with the third cap layer 251 and fourth cap layer 261 being folded toward completion of an assembled end cap 110, 120. FIG. 12 shows the blank 200 being bent at the tab connector 245 between the second cap layer 231 and the third cap layer 251. FIG. 12 also shows the blank 200 being bent at the third tab connector 255 between the third cap layer 251 and the fourth cap layer 261. The cap layers 231, 251, and 261 of blank 200 are shown bent such that the opposite side 352 of the third cap layer 251 faces the opposite side 362 of the fourth cap layer 261. In addition, bending of blank 200 is such that the outer side 230 of the second cap layer 231 is bent at tab connector 245 to face the outer side 250 of the third cap layer 251. To secure the end cap 110, 120 together, adhesive may be applied between opposite side 352 and opposite side 362 when they face each other and adhesive may also be applied between outer side 230 and outer side 250 when they face each other to seal the two sides 230, 250 together.

Figure 13:
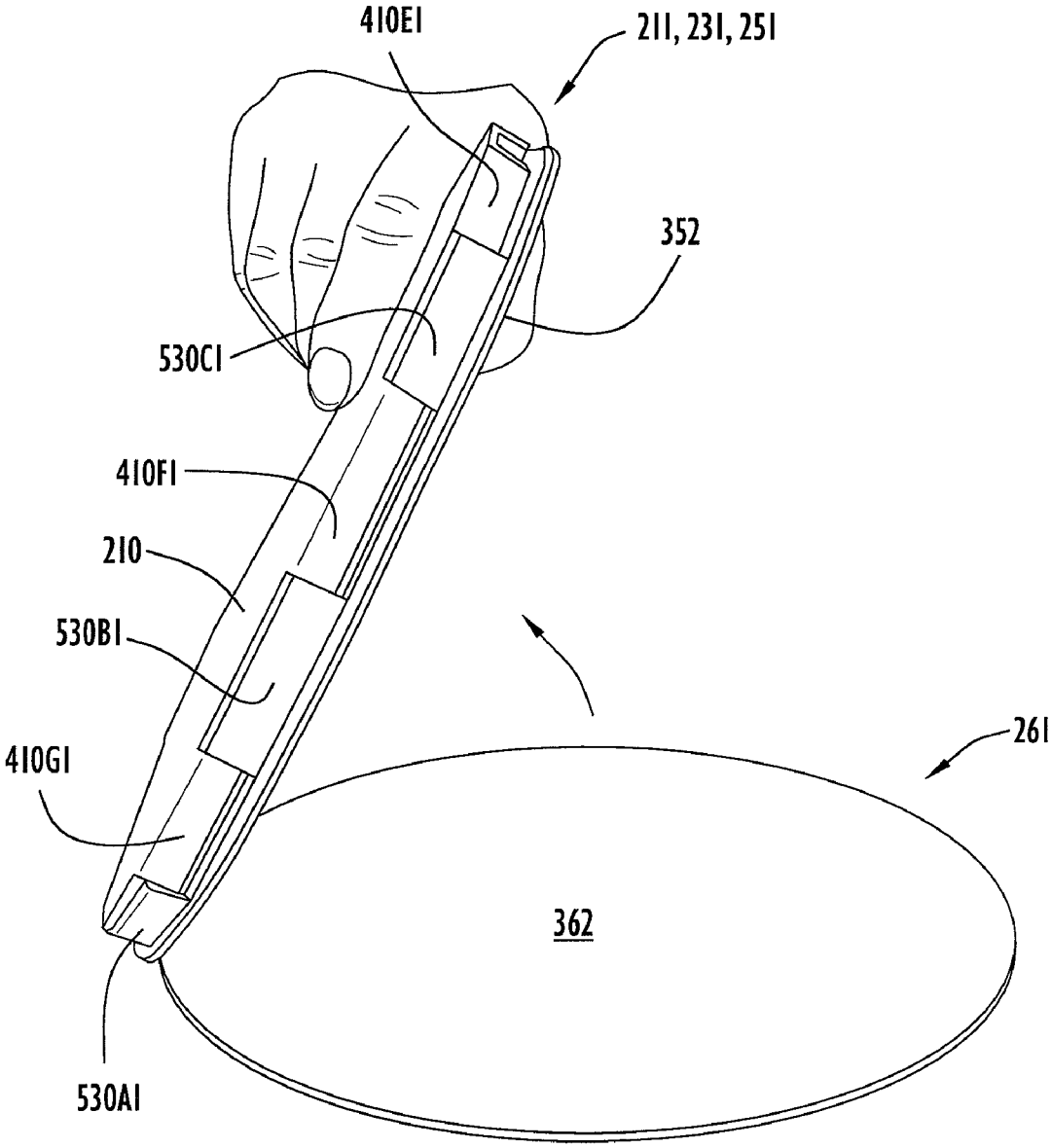
FIG. 13 illustrates a side perspective view of the assembled first, second and third cap layers with the fourth cap layer being folded into a completely assembled end cap in accordance with the present invention.

FIG. 13 illustrates a side perspective view of the assembled first cap layer 211, second cap layer 231, and third cap layer 251 with the fourth cap layer 261 being folded toward a completely assembled end cap 110, 120. Specifically, the opposite side 352 of third cap layer 251 is folded onto the opposite side 362 of fourth cap layer 261. Again, an adhesive may be applied between opposite sides 352, 362 to seal them together.

Figure 14:
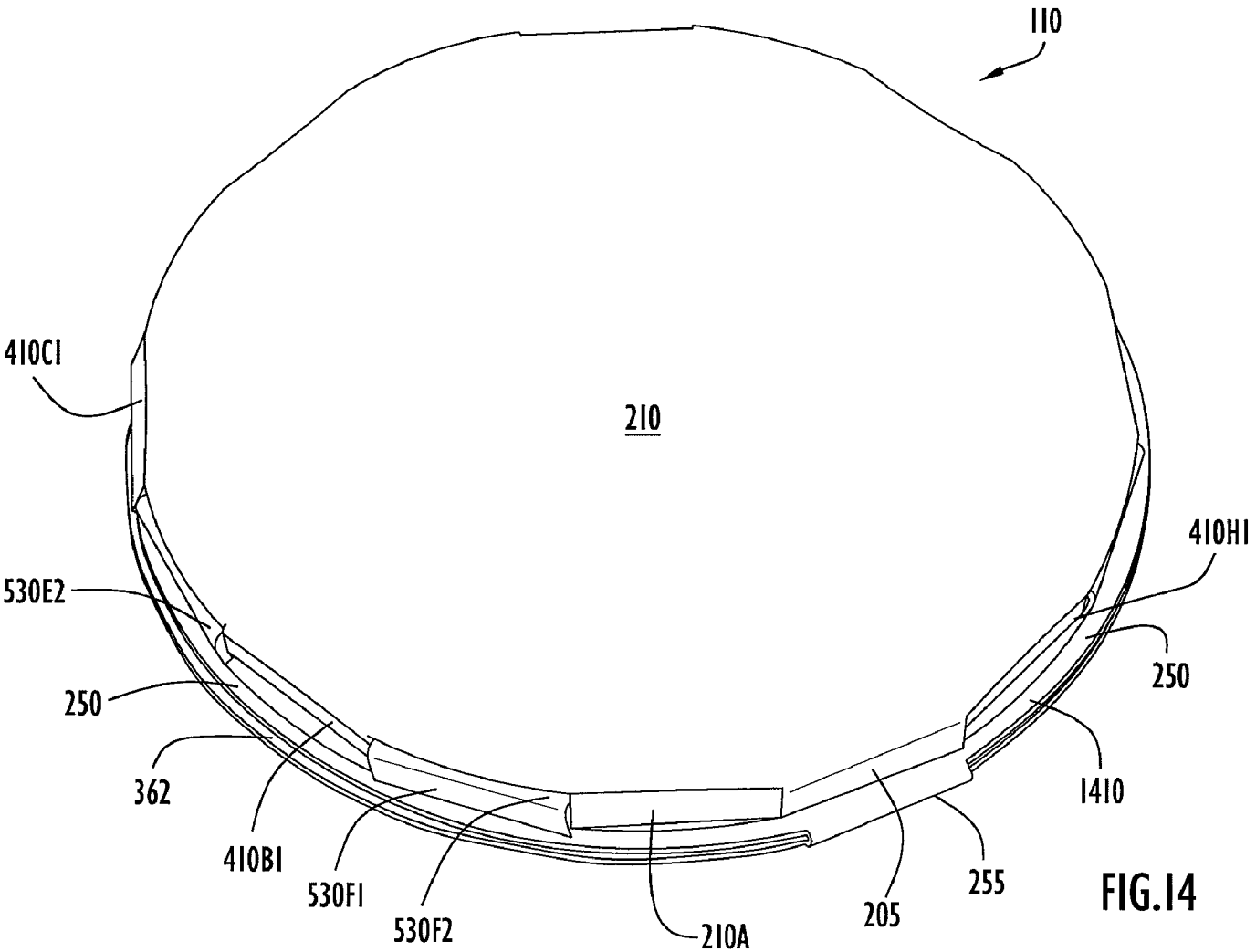
FIG. 14 illustrates a top perspective view of a completely assembled end cap in accordance with the present invention.
Figure 15:
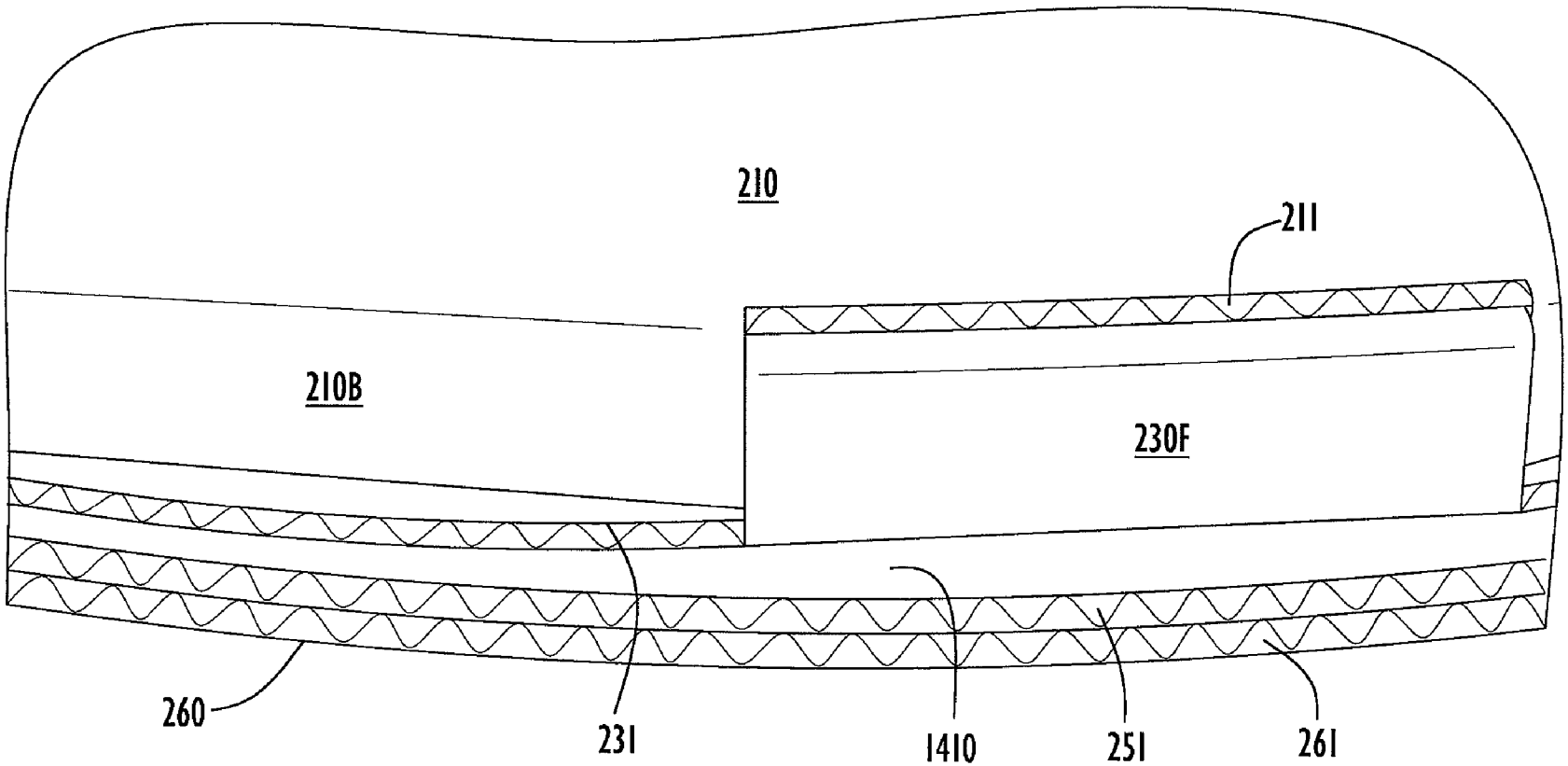
FIG. 15 illustrates an enlarged side perspective view of the completely assembled end cap of FIG. 14 showing each of the end cap layers and two of the interconnected support tabs.

FIG. 14 illustrates a top perspective view of a completely assembled end cap 110, 120. As illustrated in FIGS. 2 and 3, third cap layer 251 and fourth cap layer 261 have a larger diameter than first cap layer 211 and second cap layer 231. As a result, third cap layer 251 and fourth cap layer 261 extend past first and second cap layers 211, 231 to form a rim surface 1410. FIG. 15 illustrates a close-up side perspective view of the completely assembled end cap 110, 120 showing each of the end cap layers 211, 231, 251, and 261 and the interconnected support tabs 210A-H and 230A-F. FIG. 15 also shows the rim surface 1410 extending radially outward from support tabs 210B and 230F. When the end cap 110 is fully assembled, the inner surface of the end cap is formed from side 210, while the outer surface of the end cap is formed from side 260. Because two sides 210, 260 from a single side of the blank 200 (see the side shown in FIG. 2) form the assembled inner and outer surfaces of the fully assembled end cap 110, only the side of the blank 200 shown in FIG. 2 needs to receive any printing. In other words, because of the way that the blank 200 is folded, the side of the blank 200 shown in FIG. 2 may include printed indicia, and that indicia would appear on both sides of the fully assembled end cap 110.

Figure 16:
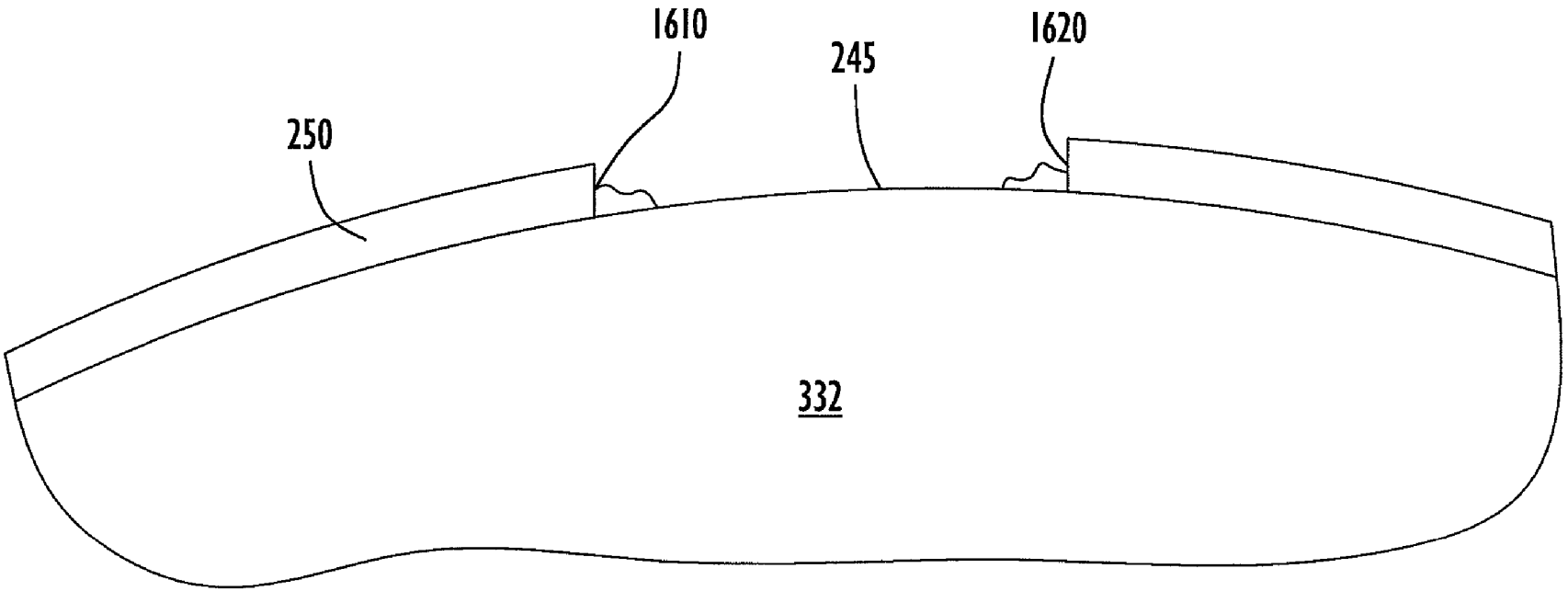
FIG. 16 illustrates a top view of the outer side of the second cap layer and the opposite side of the third cap member of an end cap in accordance with the present invention folded to reveal the second connection tab and to show the cuts that enable the folded concentric relationship between the second and third cap layers.

FIG. 16 illustrates a close-up view of the outer side 332 of the second cap layer 231 and the inner side 250 of the third cap member 251 folded to reveal the second connection tab 245 to shown the concentric relationship between the second 231 and third 251 cap layers. Also shown in FIG. 16 are a first tab cut 1610 and a second tab cut 1620. Because cap layer 251 and cap layer 261 have a larger diameter than cap layer 211 and cap layer 231 and since all of the completely assembled cap layers 211, 231, 251, and 261 must finally be concentric, first tab cut 1610 and second tab cut 1620 are provided. First tab cut 1610 and second tab cut 1620 enable the second cap layer 231 and the third cap layer 251 to be connected approximately at their perimeters yet adjust relative to each other to face each other concentrically. In other words, tab cuts 1610, 1620 enable second cap layer 231 and third cap layer 251 to be connected at their perimeters by tab connector 245 while allowing cap layer 231 to be positioned concentrically against tab layer 251.

Figure 17:
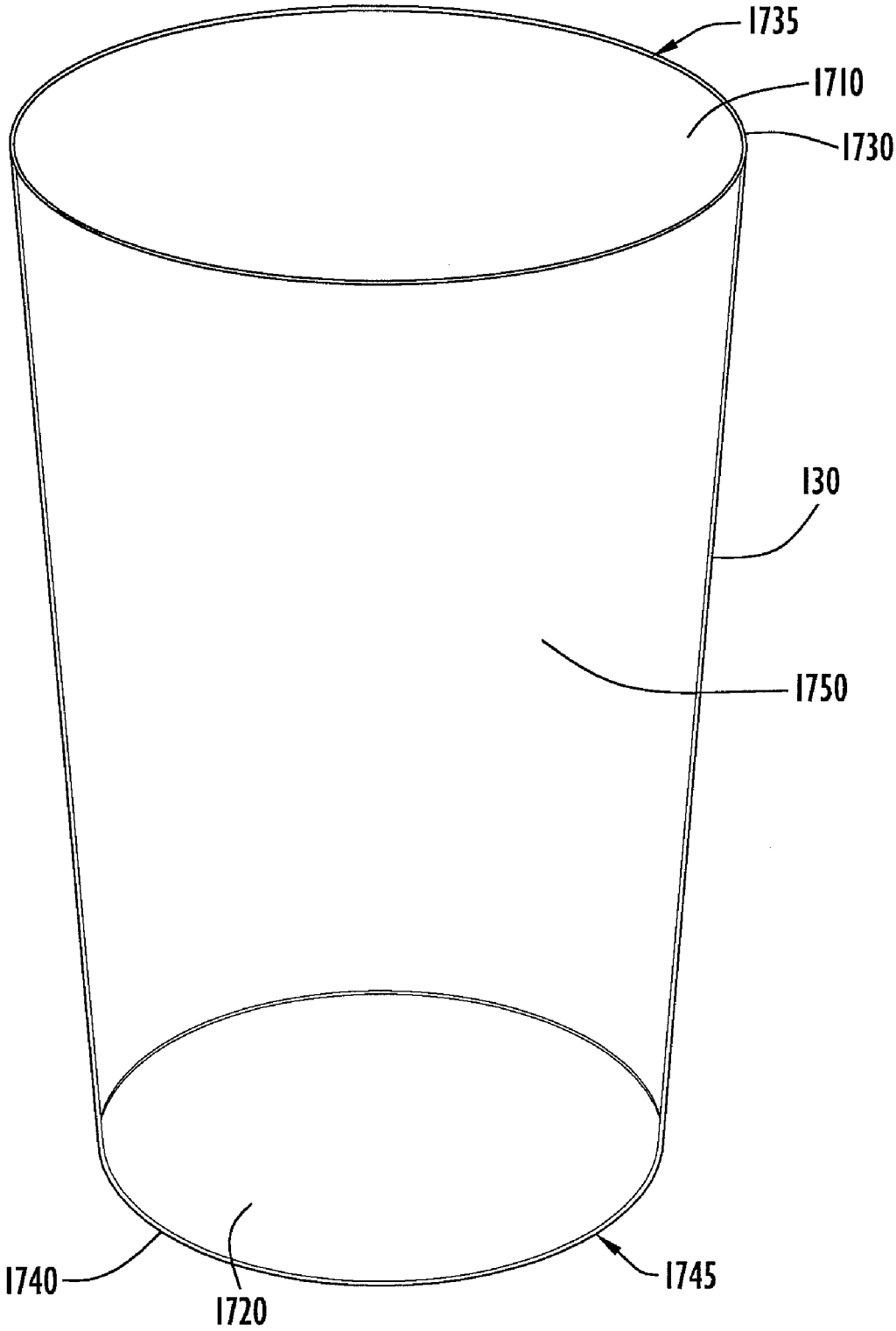
FIG. 17 illustrates a perspective view of a tubular wall member of a package in accordance with the present invention.

FIG. 17 illustrates a perspective view of the tubular wall member 130 of the packaging 110, 120 in accordance with an embodiment of the present invention. The tubular wall member 130 can be constructed from a thin flexible sheet of material. The material can be any suitable material that can be formed into a wall. As discussed above, usually, at least a portion of the wall would typically be transparent. Therefore, a flat flexible transparent plastic such as acetate may be used in the packaging. FIG. 17 shows a tubular wall member 130 including a first terminal end 1735 and a second terminal end 1745. The tubular wall member 130 also includes a first terminal end opening 1710 defined by a first wall edge 1730 and a second terminal end opening 1720 defined by a second wall edge 1740. Finally, when the tubular wall member 130 is constructed from a thin sheet of flexible material, fastening the ends of the sheet creates an overlapping seam 1750. The overlapping seam may be taped closed or closed with another type of adhesive or other fastener.

Figure 18:
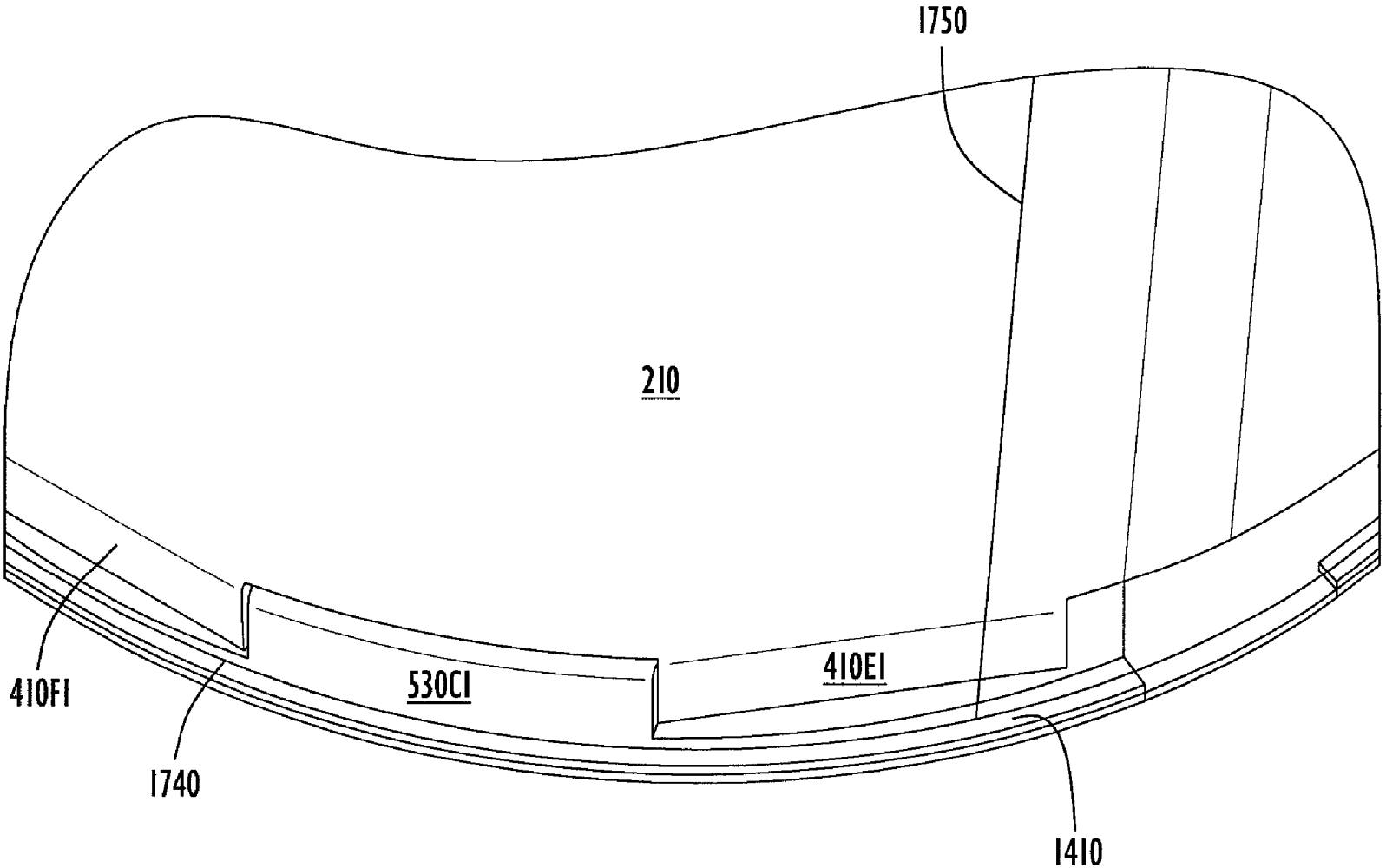
FIG. 18 illustrates an enlarged perspective view of an end cap in accordance with the present invention inserted into the bottom opening of the tubular wall member of FIG. 17.

FIG. 18 illustrates an enlarged perspective view of a portion of an embodiment of an end cap 110, 120 in accordance with the present invention inserted into the second terminal end opening 1720 of the tubular wall member 130 of the packaging 100. The portion of the end cap 110, 120 that passes through the second terminal end opening 1720 includes the first cap layer 211, the second cap layer 231 and the support tabs 210A-H, 230A-F. As mentioned above, the first cap layer 211 and the second cap layer 231 are smaller in size than the third cap layer 251 and the fourth cap layer 261. In fact, the first cap layer 211 and the second cap layer 231 are smaller in size than the first terminal end opening 1710 and the second terminal end opening 1720 of the tubular wall member 130 to allow the first cap layer 211 and the second cap layer 231 to be pass into the first terminal end opening 1710 or the second terminal end opening 1720. On the other hand, the third cap layer 251 and the fourth cap layer 261 are both larger in size than the first terminal end opening 1710 and second terminal end opening 1720 to prevent the third and fourth cap layers 251, 261 from being able to enter the first 1710 or second 1720 terminal end openings. As the third cap layer 251 and the fourth cap layer 261 of end cap 110 are too large to enter the first terminal end opening 1710, the rim surface 1410 rests on the edge 1730 of the tubular wall member 130. Similarly, since end cap 120 has a third cap layer 251 and a fourth cap layer 261 that are too large to enter the second terminal end opening 1720, the rim surface 1410 rests on the edge 1740 of the tubular wall member 130.

Figure 19:
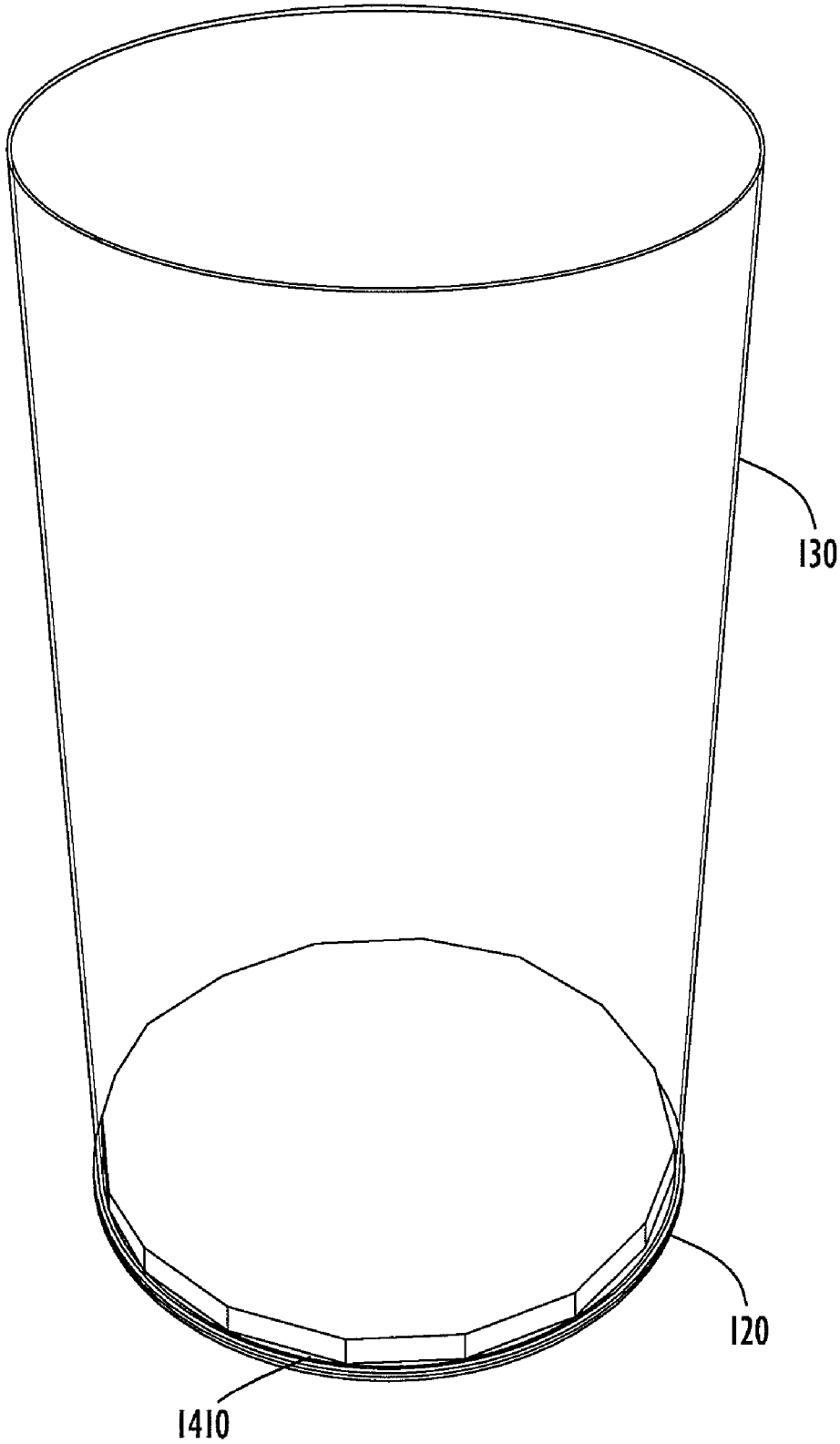
FIG. 19 illustrates a perspective view of a tubular wall member with an assembled end cap in accordance with the present invention disposed in its second open end the first opening of the wall member ready to receive another fully assembled end cap.

FIG. 19 illustrates a full perspective view of an end cap 120 assembled on a second terminal end 1745 of the tubular wall member 130. The end cap 120 can be secured to the tubular wall member 130 within terminal end opening 1720 by tape or other adhesive product. Similarly, end cap 110 can then be assembled within terminal end opening 1710 of the tubular wall member 130 by tape or adhesive. When both end caps 110, 120 are completely assembled and attached to the tubular wall member 130 (as shown in FIG. 1), the packaging 100 defines an enclosed volume in which a product for sale can be housed. The packaging end caps 120, 130 serve to provide an enclosed volume as well as add to the structural rigidity and robustness of the packaging 100.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

I claim:

1. A product package including an end cap, the product package having a wall member including a terminal end and a terminal end opening, the end cap comprising:

a continuous blank including:

a first cap layer including at least one first support tab;

a second cap layer foldably connected to the first cap layer via a first connector, the second cap layer comprising at least one second support tab offset from the first support tab; and a third cap layer foldably connected to the second cap layer via a second connector;

wherein the first and second cap layers are sized smaller than the third cap layer and smaller than the terminal end opening, the third cap layer being larger than the terminal end opening, and the blank being foldable such that the first cap layer folds relative to the second cap layer and connects to the second cap layer via the first and second support tabs and the first connector.

2. The product package of claim 1, wherein the first cap layer further includes at least one recess configured to receive the at least one second support tab.

3. The product package of claim 2, wherein the second cap layer further includes at least one recess configured to receive the at least one first support tab.

4. The product package of claim 3 further comprising a product housed within the product package.

5. The product package of claim 1, wherein the first and second cap layers of the continuous blank are configured to be inserted into the terminal end opening and the third cap layer is configured to abut the product package terminal end.

6. The product package of claim 1, further including a fourth cap layer foldably connected to the third cap layer via a third connector, wherein the fourth cap layer is larger than the terminal end opening of the product package.

7. The product package of claim 6 further comprising a product housed within the product package.

8. The product package of claim 1, wherein the end cap comprises a cardboard material.

9. The product package of claim 8 wherein at least a portion of the wall member comprises a transparent material.

10. The product package of claim 9 wherein the portion of the wall member comprises a flexible material.

11. The product package of claim 10 wherein the portion of the wall member comprises a plastic material.

12. The product package of claim 1, wherein the first cap layer includes a plurality of first support tabs and the second cap layer includes a plurality of second support tabs offset from the first support tabs.

13. The package of claim 12, wherein the first cap layer further includes a plurality of recesses operable to receive the plurality of second support tabs and the second cap layer includes a plurality of recesses operable to receive the plurality of first support tabs.

14. The product package claim 1, wherein the end cap is circular and the product package is cylindrical.

15. The product package of claim 14 wherein at least a portion of the wall member comprises a transparent plastic material.

16. The product package claim 1, wherein the end cap is rectangular and the product package is rectangular.

17. A product package comprising:

a tubular wall member including a terminal end and a terminal end opening;

an end cap comprising:

a continuous blank including:

a first cap layer including at least one first support tab;

a second cap layer foldably connected to the first cap layer via a first connector, the second cap layer comprising at least one second support tab offset from the first support tab; and a third cap layer foldably connected to the second cap layer via a second tab connector;

wherein the first and second cap layers are sized smaller than the third cap layer and smaller than the terminal end opening, the third cap layer being larger than the terminal end opening, and wherein the continuous blank is foldable such that the first cap layer folds relative to the second cap layer and connects to the second cap layer via the first and second support tabs and the first tab connector.

18. The product package of claim 17 further comprising a product housed within the product package.

* * * * *